United States Patent [19]

Hasircoglu

[11] Patent Number: 4,687,888

[45] Date of Patent: Aug. 18, 1987

[54] ELECTRICAL CONNECTOR WITH SWITCH

[75] Inventor: Alexander W. Hasircoglu, Lancaster, Pa.

[73] Assignee: E. I. Dupont De Nemours and Co., Wilmington, Del.

[21] Appl. No.: 739,033

[22] Filed: May 29, 1985

[51] Int. Cl.[4] ..... H01R 33/96

[52] U.S. Cl. ..... 200/51.1; 200/51 R; 200/153 M; 200/292

[58] Field of Search ..... 339/113 R, 113 B, 113 L; 200/51.09, 51.1, 51.11, 51 R, 153 M, 292, 159 A

[56] References Cited

U.S. PATENT DOCUMENTS

| | | | |
|---|---|---|---|
| 2,332,554 | 10/1943 | Bolley | 200/159 R |
| 2,565,895 | 8/1951 | Wadland | 240/6.45 |
| 3,476,890 | 11/1969 | Powell | 200/5 |
| 3,902,032 | 8/1975 | Koepke | 200/159 A |
| 3,902,120 | 8/1975 | Dascal et al. | 200/51.09 X |
| 3,940,581 | 2/1976 | Dorr | 200/85 A |
| 4,053,724 | 10/1977 | Llona | 200/51 R |
| 4,286,121 | 8/1981 | Olszewski et al. | 179/98 |
| 4,385,219 | 5/1983 | Finlayson | 200/159 A |
| 4,389,551 | 6/1983 | Deibele et al. | 200/51 R |
| 4,494,143 | 1/1985 | Lovick et al. | 358/122 |

FOREIGN PATENT DOCUMENTS

| | | | |
|---|---|---|---|
| 553677 | 3/1958 | Canada | 200/51.11 |
| 1220920 | 7/1966 | Fed. Rep. of Germany | 200/51.1 |

*Primary Examiner*—Henry K. Artis
*Assistant Examiner*—Ernest G. Cusick
*Attorney, Agent, or Firm*—Barry Estrin

[57] ABSTRACT

An electrical connector containing a switch which makes or breaks an electrical connection when the connector is plugged into or unplugged from a mating connector. The switch is located in an aperture in the electrical connector. It is capable of limited reciprocal motion parallel to the longitudinal axis of the aperture. The switch includes at one end a pair of normally touching contacts and a dielectric finger. Electrical connection is broken when the switch reciprocates so that the dielectric finger is interposed between the normally touching fingers and, likewise, electrical contact is made when the reciprocation movement of the switch removes the finger.

9 Claims, 4 Drawing Figures

ELECTRICAL CONNECTOR WITH SWITCH

BACKGROUND OF THE INVENTION

This invention relates to electrical connectors, and more particularly to an electrical connector containing a switch mechanism which is actuated by making or breaking the connection between the connector and a mating connector.

Electrical connectors are used in modern electronic equipment (e.g., computers) for allowing various electronic components (e.g., central processor units, printers, memory units, display devices, etc.) to be interconnected in various configurations. For example, one installation of a computer system may have one memory unit connected to the central processor, while another installation of that system may have two memory units connected to the central processor. Plug-type connectors are used to allow quick and easy assembly of the desired system configuration, as well as subsequent modification of that configuration.

The central processor typically requires information as to the presence or absence of other system components. For example, the central processor typically needs to know how many memory units are connected to the system in order to determine the amount of memory available for use by the central processor. There are several known ways of making this information available to the central processor, but all are relatively complex, expensive, and otherwise disadvantageous. For example, a dummy load device can be plugged into each unused connector in order to allow the central processor to determine that those connectors are unused. Among the disadvantages of this technique are (1) the cost of manufacturing and inventorying dummy loads, (2) the possibility that required dummy loads will be inadvertently omitted or removed, and (3) the fact if a connector is put into use or taken out of use while the system is operating, the state of use of the connector is indeterminate during the time interval in which neither the dummy load nor the real load is plugged into the connector. This last point may make it necessary to shut down the system before making any change in its configuration.

In view of the foregoing, it is an object of this invention to provide improved and simplified apparatus for indicating whether or not an electrical connector is connected to a mating connector.

It is another object of this invention to provide electrical connector apparatus for automatically indicating whether or not the connector is connected to a mating connector.

SUMMARY OF THE INVENTION

These and other objects of the invention are accomplished in accordance with the principles of the invention by providing an electrical connector containing an electrical switch which is operated when the connector is plugged into a mating connector. Accordingly, the state of this switch indicates whether or not the connector is in use. The making or breaking of the switch can be timed in any desired manner relative to the making or breaking of the connection between the mating connectors. All of the parts which must be specially shaped to produce and operate the switch can be confined to the connector containing the switch so that the mating connector can be a completely standard and conventional part.

Further features of the invention, its nature and various advantages will be more apparent from the accompanying drawings and the following detailed description of the invention.

DETAILED DESCRIPTION OF THE INVENTION

Figure 1:
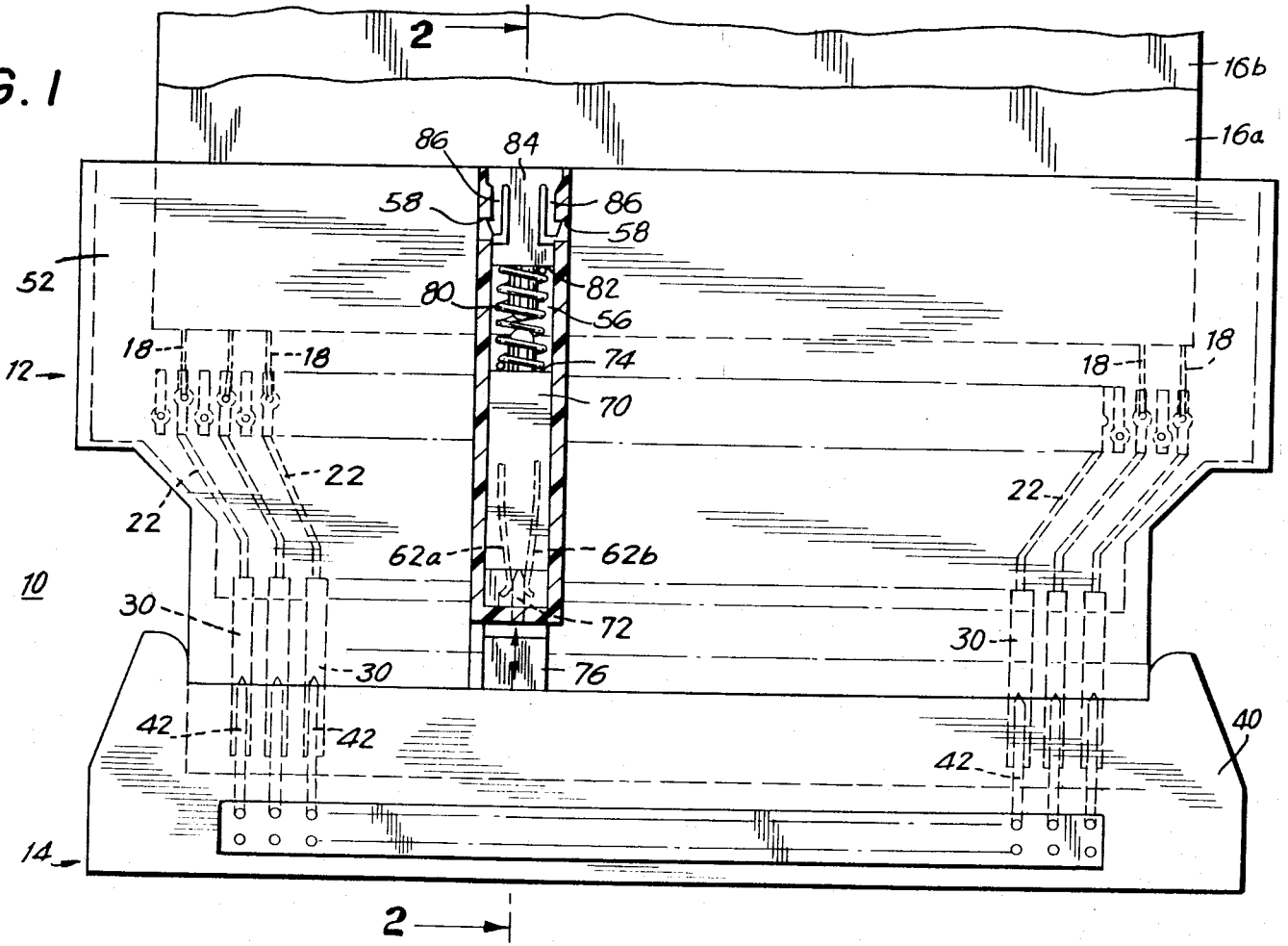
FIG. 1 is a bottom plan view, partly in section, of an illustrative connector constructed in accordance with the principles of this invention.
Figure 2:
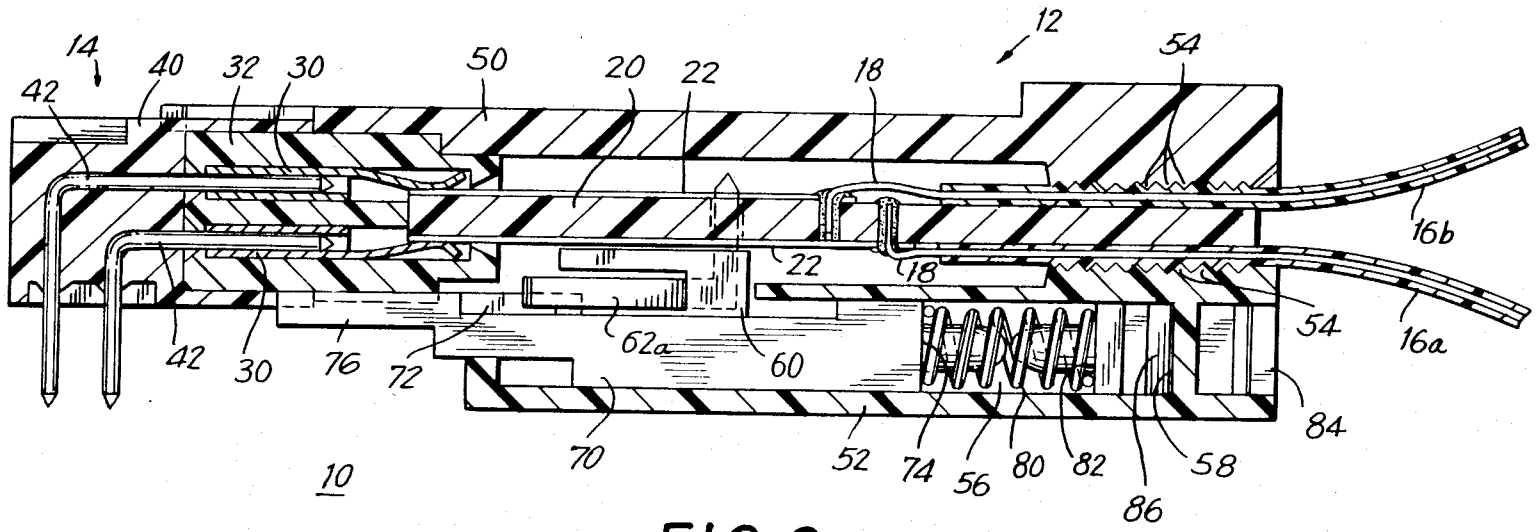
FIG. 2 is a sectional view taken along the line 2—2 in FIG. 1.

As shown in FIGS. 1 and 2, illustrative electrical connector 10 includes plug portion 12 which can be plugged into or unplugged from header portion 14. Plug 12 is specially constructed in accordance with this invention; header 14 can be completely conventional.

In the depicted embodiment, plug 12 is the termination of two flat ribbon cables 16*a* and 16*b*, each of which includes a plurality of parallel, laterally spaced, co-planar, separately insulated electrical conductors (wires) 18. Cables 16*a* and 16*b* enter the rear of plug 12 on opposite sides of printed circuit board ("PCB") 20. The wires 18 of cables 16 are electrically connected in any conventional manner to the circuit traces 22 printed on PCB 20. Circuit traces 22 electrically connect wires 18 to female terminal members 30 arrayed along the front surface of plug 12. In the depicted embodiment, terminals 30 are arranged in two parallel rows, but it will be understood that any arrangement of terminals 30 could be used.

The front or nose portion of plug 12 is pluggable into a socket in the body 40 of header 14. Header body 40 supports a plurality of male terminal pins 42 in an array corresponding to the array of female terminals 30 in plug 12. Accordingly, when plug 12 is plugged into header 14, each of male terminal pin 42 enters and electrically contacts a respective one of female terminals 30. Preferably, each and every female terminal member 30 has an associated male terminal pin 42. In the depicted embodiment, male terminal pins 42 are bent at right angles in header body 40 and project from the bottom of the header body for connection to other electronic apparatus such as a large printed circuit board (not shown).

It will be understood that although female terminal members 30 are shown in plug 12 and male terminal pins are shown in header 14, this is not necessarily the case. For example, the male and female terminals could be reversed, or hermaphroditic terminals could be used in both connector components.

Female terminal members 30 are disposed in nose piece 32 which fits on the front edge of PCB 20. PCB 20 and nose piece 32 are sandwiched between upper and lower plug housing members 50 and 52. Housing members 50 and 52 are held together in any conventional manner such as by latches, adhesive, rivets, or the like. The rear portions of housing members 50 and 52 pinch cables 1*a* and 16*b* against PCB 20 to help secure plug 12 to the cables. If desired, ridges 54 transverse to the longitudinal axes of cables 16 can be provided on the inner surfaces of housing members 50 and 52 in contact with cables 16. These ridges increase the strength of the mechanical connection between plug 12 and cables 16.

Figure 3:
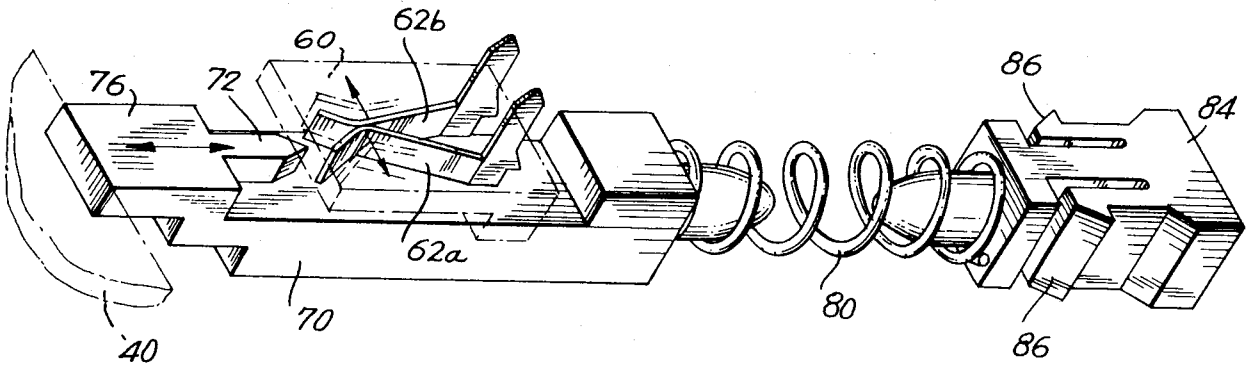
FIG. 3 is a perspective view of a portion of the apparatus of FIGS. 1 and 2.

Mounted on PCB 20 at any desired point along the width of plug 12 (width being measured in this case transverse to the longitudinal axes of cables 16 and parallel to the plane of PCB 20) is a dielectric contact support 60. Contact support 60 carries two L-shaped leaf spring switch contacts 62*a* and 62*b*. For convenience, switch contacts 62*a* and 62*b* will hereinafter be referred to collectively as 62. The forward portions of contacts 62 (adjacent to terminals 30) are cantilevered from contact support 60 parallel to the plane of PCB 20 and are resiliently biased toward one another so that they normally touch as shown in solid lines in FIG. 3. In this condition contacts 62 make an electrical connection between them. The rearward portions of contacts 62 (adjacent to the ends of cables 16) extend perpendicular to the plane of PCB 20. The rearward portion of each contact 62 is electrically connected to a respective one of two PCB circuit traces 22. In the depicted preferred embodiment, contacts 62 extend through PCB 20 so that they can be connected to circuit traces on either side of PCB 20 as desired. This arrangement also allows contacts 62 to be used as the principal or sole means for mechanically mounting contact support 60 on PCB 20.

Lower housing member 52 has an aperture 56 extending longitudinally all the way through plug 12 parallel to the longitudinal axes of cables 16. A switch actuator member 70 is disposed and retained in the forward portion of aperture 56 (i.e., the portion adjacent to terminals 30) for limited reciprocal motion parallel to the longitiudinal axis of aperture 56. Switch actuator 70 includes a dielectric finger 72 which is interposed between the normally touching forward ends of contacts 62 when actuator 70 is pushed in the rearward direction. In this position of actuator 70, finger 72 separates contacts 62 and thereby breaks the electrical connection between them. On the other hand, when actuator 70 moves to its forward position (shown in solid lines in FIG. 3), finger 72 moves out from between contacts 62, thereby allowing those contacts to contact one another and make an electrical connection between them.

Actuator member 70 is resiliently biased to move in the forward direction (away from cables 16) by compression coil spring 80 which is compressed between a rearward facing surface 74 of actuator 70 and a forward facing surface 82 of stop member 84. To facilitate assembly of the apparatus, elements 70, 80, and 84 are insertable into aperture 56 from the rear. Stop member 84 latches into the rear of aperture 56 by means of resilient latching fingers on stop member 84 in cooperation with latching surfaces 58 on housing member 52.

The forward end portion 76 of actuator member 70 extends forwardly from the forward end of aperture 56 so that when plug 12 is plugged into header 14, a portion of header body 40 contacts the end of actuator 70 and pushes it to the rear. This causes finger 72 to separate contacts 62, thereby breaking the electrical connection between those contacts. Accordingly, the act of plugging plug 12 into header 14 breaks the electrical connection between contacts 62. On the other hand, when plug 12 is removed from header 14, spring 80 pushes actuator member 70 in the forward direction. This removes finger 72 from between contacts 62, thereby allowing contacts 62 to spring together and make an electrical connection between them. Accordingly, the act of unplugging plug 12 from header 14 makes the electrical connection between contacts 62. The apparatus connected to plug 12 via cables 16 can use the making or breaking of the connection between contacts 62 in any desired manner for any desired purpose such as determining whether or not plug 12 is plugged into header 14.

Figure 4:
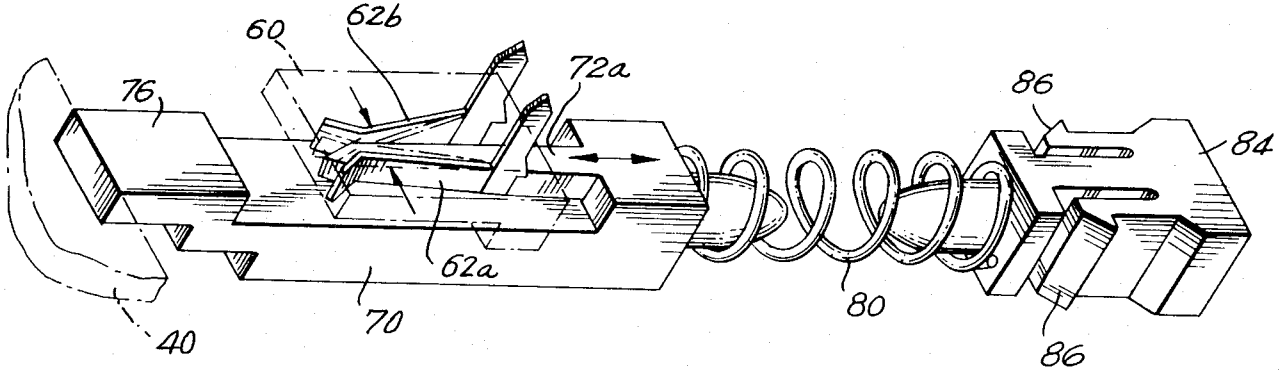
FIG. 4 is a perspective view similar to FIG. 3 illustrating an alternative embodiment of the invention.

FIG. 4 illustrates an alternative embodiment of the invention in which finger 72*a* is reversed so that contacts 62 make (rather than break) when plug 12 is plugged into header 14, and so that contacts 62 break (rather than make) when plug 12 is unplugged from header 14. In other respects the embodiment of FIG. 4 can be similar to the embodiment of FIGS. 1–3.

Those skilled in the art will appreciate that by appropriate design of the switch of this invention (e.g., by appropriate choice of the length of finger 72 or 72*a*), the making and breaking of contacts 62 can be timed in any desired manner relative to the making and breaking of the connections between elements 30 and 42. For example, in the embodiment of FIGS. 1–3, contacts 62 can be made to break just prior to making of the connections between elements 30 and 42. Alternatively, contacts 62 can be made to break at the same time as or shortly after the making of the connections between elements 30 and 42.

I claim:

1. Electrical connector apparatus comprising:

a first connector assembly having a first housing containing a plurality of first electrical terminals arrayed on a first surface of the first housing and a circuit board disposed perpendicular to said first surface, the first terminals being connected to the circuit board along a first edge of the circuit board;

a second connector assembly having a second housing containing a plurality of second electrical terminals arrayed on a second surface of the second housing so that each second terminal releasably contacts a respective one of the first terminals when the first and second surfaces are brought together;

a switch actuator member mounted and retained in the first housing for limited reciprocal motion along a first axis perpendicaular to the first surface, the actuator member including a dielectric finger extending through the first surface and being resiliently biased to move outwardly of the first housing along the first axis;

means associated with the second connector assembly for reciprocating the actuator member inwardly of the first housing along the first axis when the first and second surfaces are brought together; and switch contact means disposed in the first housing, said switch contact means including contact members resiliently biased toward and normally in contact with one another in response to reciprocation of the actuator member in a first direction along the first axis, whereby reciprocation of the actuator member in an opposite second direction along the first axis causing said contact members to thereby break said electrical contact.

2. The apparatus defined in claim 1 wherein the housing includes an aperture parallel to the first axis and wherein the actuator member is disposed in the aperture.

3. The apparatus defined in claim 2 wherein the actuator member is resiliently biased by means of a spring disposed in the aperture and compressed between a surface of the actuator member which faces away from the first surface and a stop member inserted in the portion of the aperture remote from the first surface.

4. The apparatus defined in claim 3 wherein stop member is retained in the aperture by latch means operative between the stop member and the first housing.

5. The apparatus defined in claim 1 wherein the contact members pass through the circuit board perpendicular to the plane of the circuit board.

6. The apparatus defined in claim 1 wherein the circuit board comprises:

a plurality of electrical conductors disposed along a second edge of the circuit board remote from the first edge for electrically connecting the circuit board to a plurality of electrical circuits external to the connector; and a plurality of circuit traces for electrically connecting the first terminals to the conductors.

7. The apparatus defined in claim 6 wherein each of the contact members is electrically connected to a respective one of the circuit traces.

8. The apparatus defined in claim 6 wherein the external circuits are the wires in a ribbon cable, and wherein the first housing clamps the end of the ribbon cable against the circuit board adjacent the second edge.

9. The apparatus defined in claim 1 wherein the contact members are first and second leaf springs cantilevered from the circuit board and resiliently biased into contact with one another.

* * * * *